US007110553B1

(12) United States Patent
Julstrom et al.

(10) Patent No.: US 7,110,553 B1
(45) Date of Patent: Sep. 19, 2006

(54) DIRECTIONAL MICROPHONE ASSEMBLY FOR MOUNTING BEHIND A SURFACE

(75) Inventors: Stephen D. Julstrom, Chicago, IL (US); Robert B. Schulein, Evanston, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

(21) Appl. No.: 09/017,937

(22) Filed: Feb. 3, 1998

(51) Int. Cl.
*H04R 9/08* (2006.01)

(52) U.S. Cl. ..... 381/86; 381/356; 381/357

(58) Field of Classification Search ..... 381/92, 381/313, 356, 365, 357, 86, 389, 355, 361, 381/358

See application file for complete search history.

(56) References Cited

U.S. PATENT DOCUMENTS 3,995,124 A 11/1976 Gabr
4,399,327 A * 8/1983 Yamamoto et al. ..... 381/92
4,629,828 A * 12/1986 Umebayashi ..... 379/56.1
4,827,520 A * 5/1989 Zeinstra ..... 701/1
4,875,229 A * 10/1989 Palett et al. ..... 455/569.2
5,058,170 A 10/1991 Kanamori et al.
5,325,435 A 6/1994 Date et al.
5,373,555 A * 12/1994 Norris et al. ..... 379/430
5,473,684 A * 12/1995 Bartlett et al. ..... 381/92
5,515,445 A * 5/1996 Baumhauer et al. ..... 381/92
5,757,933 A * 5/1998 Preves et al. ..... 381/313
5,778,083 A 7/1998 Godfrey
6,122,389 A * 9/2000 Grosz ..... 381/361
6,332,028 B1 * 12/2001 Marash ..... 381/92
6,831,987 B1 * 12/2004 Killion et al. ..... 381/313

FOREIGN PATENT DOCUMENTS

JP 0033396 2/1983

* cited by examiner

*Primary Examiner*—Brian T. Pendleton
(74) *Attorney, Agent, or Firm*—McAndrews, Held & Malloy, Ltd.

(57) ABSTRACT

A directional microphone assembly suitable for subsurface mounting. A directional pickup pattern is developed from the outputs of a plurality of omnidirectional microphone elements mounted in an assembly behind a surface such that their acoustic excitation comes from the opposite side of the surface through small openings in the surface. The openings may have varying dimensions and may be covered with acoustically semi-transparent material without significantly degrading the assembly frequency response or polar pattern. Precautions are taken to ensure design robustness considering practical microphone element characteristics and potential high levels of low-frequency excitation.

9 Claims, 14 Drawing Sheets

PRIOR ART

DIRECTIONAL MICROPHONE ASSEMBLY FOR MOUNTING BEHIND A SURFACE

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to directional microphone assemblies, and particularly to those which may be used in applications which benefit from minimum visual intrusion. A primary example of these applications is use in vehicle cabins for speech pickup for hands-free telephony and other communication and control applications. Both omnidirectional and directional microphones have been used for this purpose. These are generally mounted on interior surfaces, most typically at a forward, central headliner position or near the top of the driver side roof-support pillar. Omnidirectional microphones have also been mounted behind such surfaces, with sound entering through a relatively small surface hole or group of holes or slots. This behind-the-surface mounting is aesthetically preferable to over-the-surface mounting and eliminates the need for designers to consider microphone styling and color.

Directional microphones can produce significant performance advantages over omnidirectional ones in the vehicle environment, however, and are therefore preferable. Compared to an omnidirectional microphone, an optimally positioned, well-designed, surface-mounted first-order directional microphone can produce a several decibel advantage in the ratio of speech pickup to general road noise, and an even greater advantage in rejection of localized ventilation noises and return telephony audio.

Although encased directional microphones, where the microphone elements are contained within mostly acoustically opaque housings, are presently available for other applications, most notably for use in hearing aids and, more recently, in some portable telephones and computer monitors, these prior art approaches have requirements and characteristics which make them less than optimum for subsurface applications such as the just described vehicle use. A typical prior art approach is shown cutaway in FIG. 1. A small (approximately 1 cm tall) electret microphone element 11 is mounted perpendicularly behind a thin surface 13. The front of the element diaphragm acoustically couples through tube 15 and surface hole 17 to the acoustic pickup region 19. Similarly, the rear of the element diaphragm acoustically couples through tube 21 and surface hole 23 to pickup region 19. Acoustic resistor 25 in tube 21, in conjunction with the enclosed rear volume 27 behind the element diaphragm, form a low-pass filter/delay for sound entering hole 23. This delay, in conjunction with the tube dimensions of the front and rear sound entry paths and the spacing distance between entry holes 17 and 23, forms a first-order directional pickup pattern in the pickup region which is directed along a line from rear entry hole 23 to front entry hole 17.

This prior art approach can be implemented to operate effectively over a useful frequency range. Its acoustical characteristics are, however, critically dependent on the individual and relative acoustical characteristics of the front and rear sound entry paths. Included in these paths are the mounting surface 13, surface holes 17 and 23, and anything which may be placed in front of them. Were such an assembly to be installed behind an automotive interior surface, the sound entry paths would be modified by considerable additional surface thickness with varying additional entry hole sizes and possibly by acoustically semi-transparent decorative covering material. These additional acoustical elements would degrade each of the front and rear sound entry paths differently, since each presents different acoustic impedance at entry holes 17 and 23. The driving force on the element diaphragm is derived from the difference of the pressures on its front and rear sides and may have a magnitude which is only a relatively small percentage of the individual front and rear pressure magnitudes. Relatively small unbalanced changes in the front and rear pressures can, then, result in much larger relative changes in the net diaphragm driving force, causing the mounted microphone assembly pickup characteristics to suffer severe degradation.

What is needed, then, is another approach to creating a subsurface directional microphone. It should be capable of attachment behind an interior surface, with acoustic entry provided by relatively small and unobtrusive openings. It should exhibit a high degree of insensitivity to the characteristics of the acoustic entry paths through the surface.

Therefore, an object of the present invention is to provide a directional microphone assembly which can be unobtrusively mounted behind a surface.

Another object is to provide such an assembly which exhibits greatly reduced sensitivity to variations in the acoustical coupling through the surface.

Another object is to provide such an assembly with reduced sensitivity to variations in microphone element characteristics.

Another object is to provide such an assembly with reduced sensitivity to very low frequency inputs.

Another object is to provide such an assembly with extended high frequency response.

A further object is to provide such an assembly which also includes an additional output with more extended low frequency response and reduced directionality.

Yet another object is to provide a similar assembly which can provide two or more directional patterns aimed in different directions.

BRIEF SUMMARY OF THE INVENTION

These and other objects are achieved in the disclosed embodiments of the invention through the use of an array of two or more omnidirectional microphone elements, each with their diaphragms acoustically coupled through openings in the microphone assembly case and in the mounting surface to the pickup region on the other side of the surface. These acoustical coupling paths are acoustically sealed such that significant microphone element excitation comes only from sound entering from the pickup region.

The output signals of two such microphone elements are combined to create a first-order directional pickup pattern. In a possible variation, the difference of the two signals is taken to create a bidirectional pickup pattern. One of the signals can be delayed before the difference is taken, allowing first-order patterns other than bidirectional to be created.

The described structure is considerably less sensitive than the prior art to coupling degradations from the mounting surface for several reasons. First, the coupling from the element diaphragm to the surface opening is more direct, presenting a simpler acoustic impedance to the opening. Second, the impedance presented to each opening is identical. Assuming substantial similarity in the openings, some small degradation of frequency response and level might be experienced with, for example, a semi-transparent cloth covering, but potentially much larger response and pattern variations resulting from differing degradations of amplitude and phase response at each coupling is avoided. Third, assuming that well-controlled directionality is not required at very high frequencies, the microphone elements and their openings can be positioned farther apart than is practical with the prior art. The desired sound pickup can then result in larger pressure differences at the microphone elements in comparison to degradation-related differences than would otherwise occur. For a pickup pattern between cardioid and supercardioid, a preferred embodiment employs a spacing distance between the openings of, for example, 3.5 cm, allowing the maintenance of good directionality to past 3 kHz.

The present invention also includes several features to minimize the microphone assembly's sensitivity to the effects of amplitude and phase response mismatches between the elements. These effects have generally been overlooked or not fully addressed in prior art descriptions of differenced microphone arrays. The present invention employs the maximum practical inter-element spacing to maximize the desired acoustical signal differences while minimize any degradations which occur as a result of coupling or mismatches in the elements. Since the greatest mismatch-induced response and pattern errors appear in the lower frequencies where the desired acoustical signal differences are smallest, aberrant behavior from the resultant exaggerated low-frequency responses is minimized by the inclusion of a high-pass filter following the pattern-generating differencing operation. Such a filter clearly demarcates the lower end of the useful frequency range. This filter may also be conveniently used to shape the assembly's frequency response just above this lower end. Very low-frequency transient problems may also be minimized by the use of matching high-pass filters applied to the microphone element signals before significant signal amplification takes place. Finally, since the greatest source of inter-element phase mismatch results from differences in the low-frequency extension of the elements' low-frequency cutoffs, the phase mismatch error source can be minimized by employing microphone elements with well-controlled, very low, low-frequency cutoffs.

In a related embodiment, at least three microphone elements are used to generate at least two directional patterns aimed in different directions. In the case of three elements being used to create two patterns, one of the elements is employed in common to generate both patterns. An automatic selection process based on the acoustic input to the microphone assembly may be employed to selectively combine the patterns.

These and other advantages and novel features of the present invention, as well as details of an illustrated embodiment thereof, will be more fully understood from the following description and drawings.

In a further related embodiment, an additional output is provided which is derived solely from one of the microphone elements. This output may be formed in relation to a local ground which is separated from the main output ground by an isolating impedance and with an output impedance that is much higher than the expected load impedance.

DETAILED DESCRIPTION OF THE INVENTION

Figure 1:
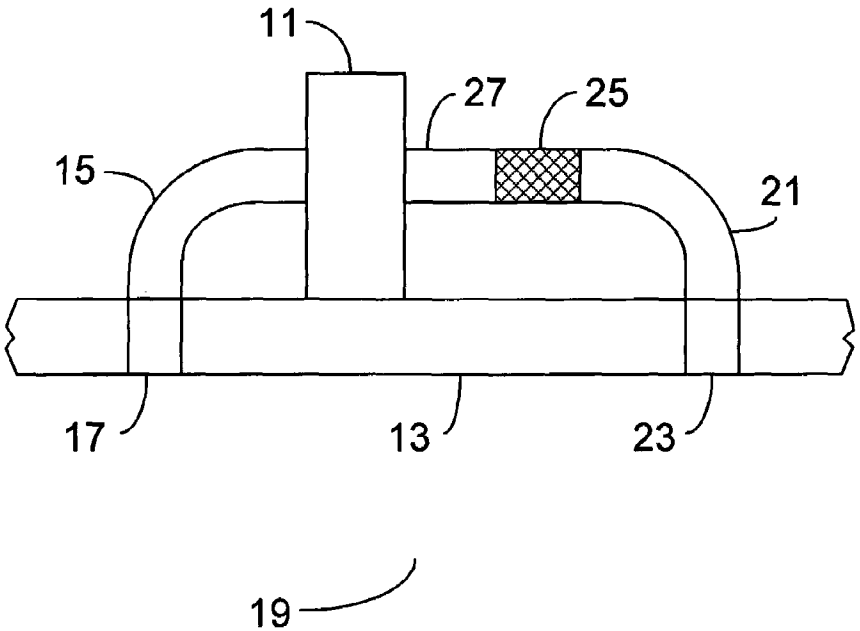
FIG. 1 is a cutaway diagrammatic view of a typical prior art subsurface directional microphone.
Figure 2:
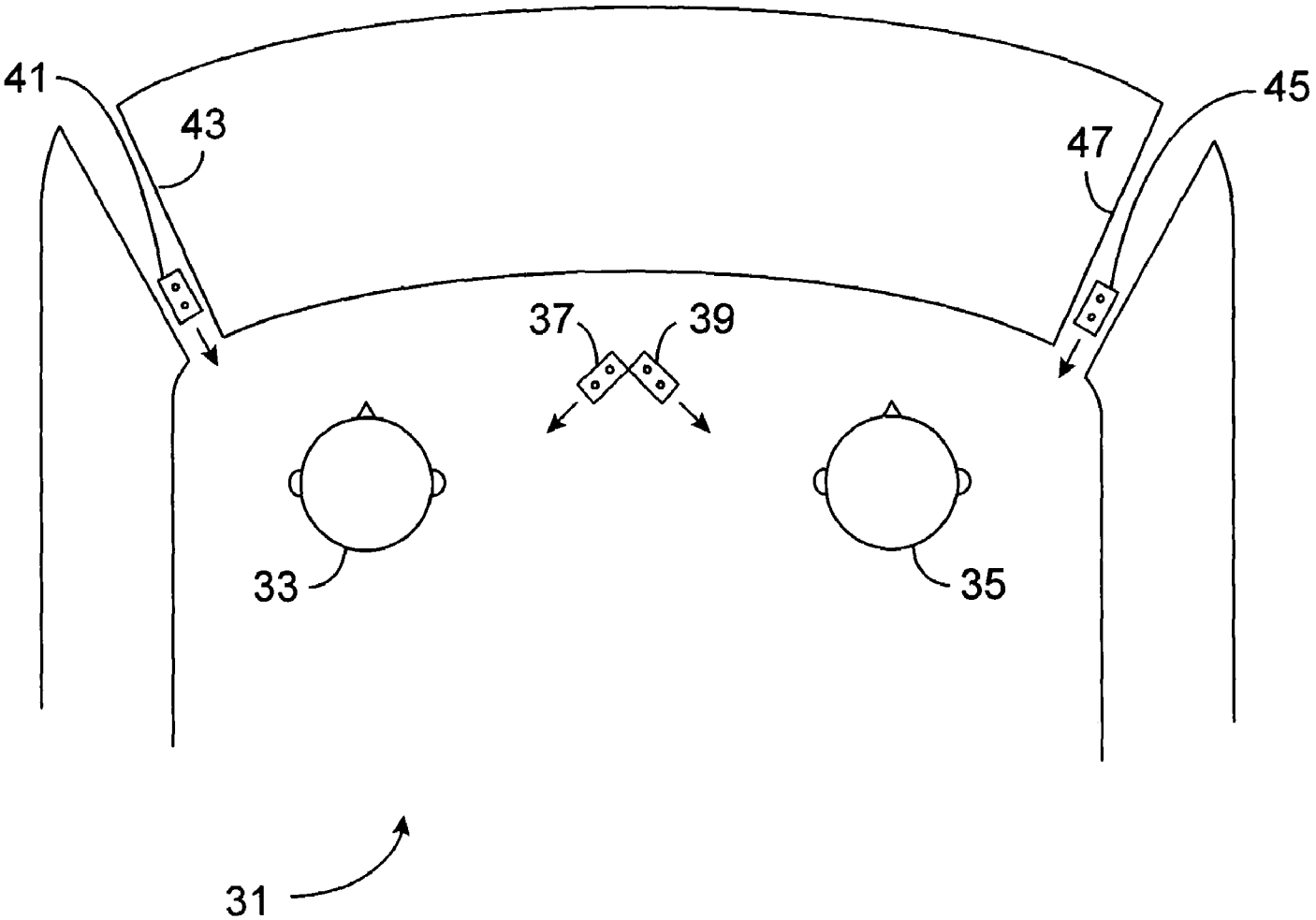
FIG. 2 is a partial top view of a vehicle cabin showing typical positioning of microphone assemblies of the present invention.

FIG. 2 illustrates a typical application for the present invention. A partial top view of a vehicle cabin 31 is shown with a left-hand driver 33 and a right-hand passenger 35. For right-hand drive vehicles, the driver and passenger positions are interchanged. A microphone assembly 37 of the present invention intended for speech pickup for hands-free telephony and other communication and control applications is shown mounted to and behind the cabin interior trim roof headliner or behind the surface of a headliner-mounted accessory console. For a telephony application, the assembly should generally provide a well-controlled directional pattern and frequency response over a frequency range of approximately 300 Hz to 3 kHz. For applications such as speech recognition and in-car speech reinforcement, useful response may need to extend to 5 kHz or beyond, but with some relaxation of directional pattern accuracy being acceptable. Within the constraint that the directional pattern must ordinarily be developed aiming parallel to the mounting surface, the horizontal aiming direction is generally in the direction of the driver. Choosing an optimum aiming direction and polar pattern requires a compromise among several factors. Often, a polar pattern between cardioid and supercardioid which is aimed slightly behind an average driver's head position provides the best balance between pickup of driver speech from the variety of driver head positions and rejection of dashboard-originating ventilation, defogger fan noises and return telephony audio. This aiming angle is typically about 45 degrees away from the cabin centerline, towards the driver. To improve pickup of front-seat passenger speech, another microphone assembly 39 may be symmetrically positioned towards the passenger. Automatic microphone assembly signal combining based on speech input to the assemblies may be employed to prevent signal-to-noise degradation of roughly 3 decibels compared to each individual microphone which would occur with the simple addition of the assembly signal outputs. An appropriate combining method is described in U.S. Pat. No. 5,673,327, issued to Stephen D. Julstrom and entitled "Microphone Mixer", which patent is incorporated herein by reference. Alternately, if only the single microphone assembly 37 is used and secondary, albeit reduced quality, coverage of the passenger is still desired, an angling of about 30 degrees away from the centerline may be more appropriate to avoid placing the passenger too far off the main pickup axis of the assembly.

Another possible installation is shown by microphone assembly 41 mounted behind the interior surface covering of driver-side roof support pillar 43. In vehicles with more steeply swept-back windshields, this positioning can provide a close microphone positioning to the driver's mouth, along with reasonable rejection of dashboard-originating interfering noises. To improve pickup of front-seat passenger speech, another microphone assembly 45 can be similarly mounted to passenger-side roof support pillar 47, and automatic signal combining applied.

Figure 10:
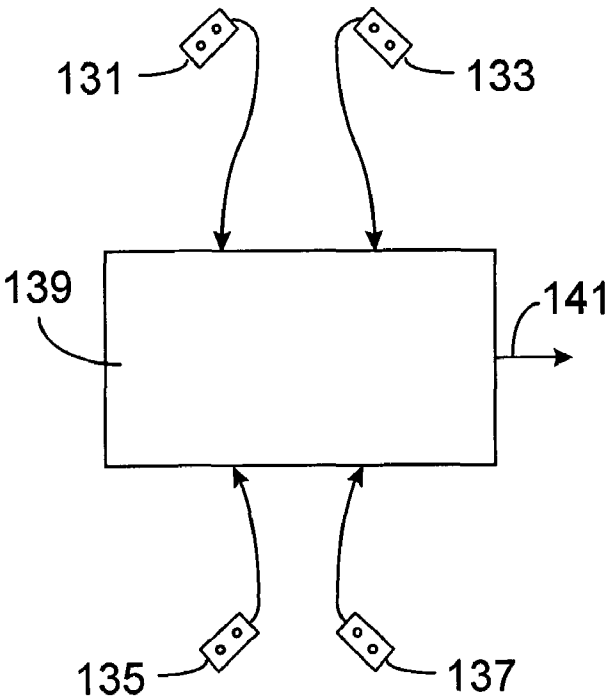
FIG. 10 shows multiple microphone assemblies and an automatic selector/combiner in accordance with the present invention.

As will be discussed in relation to FIG. 10, additional microphone assemblies beyond two may also be employed to facilitate even more complete coverage of a vehicle cabin. Automatic combining becomes more desirable as the number of microphone assemblies employed increases.

Figure 3:
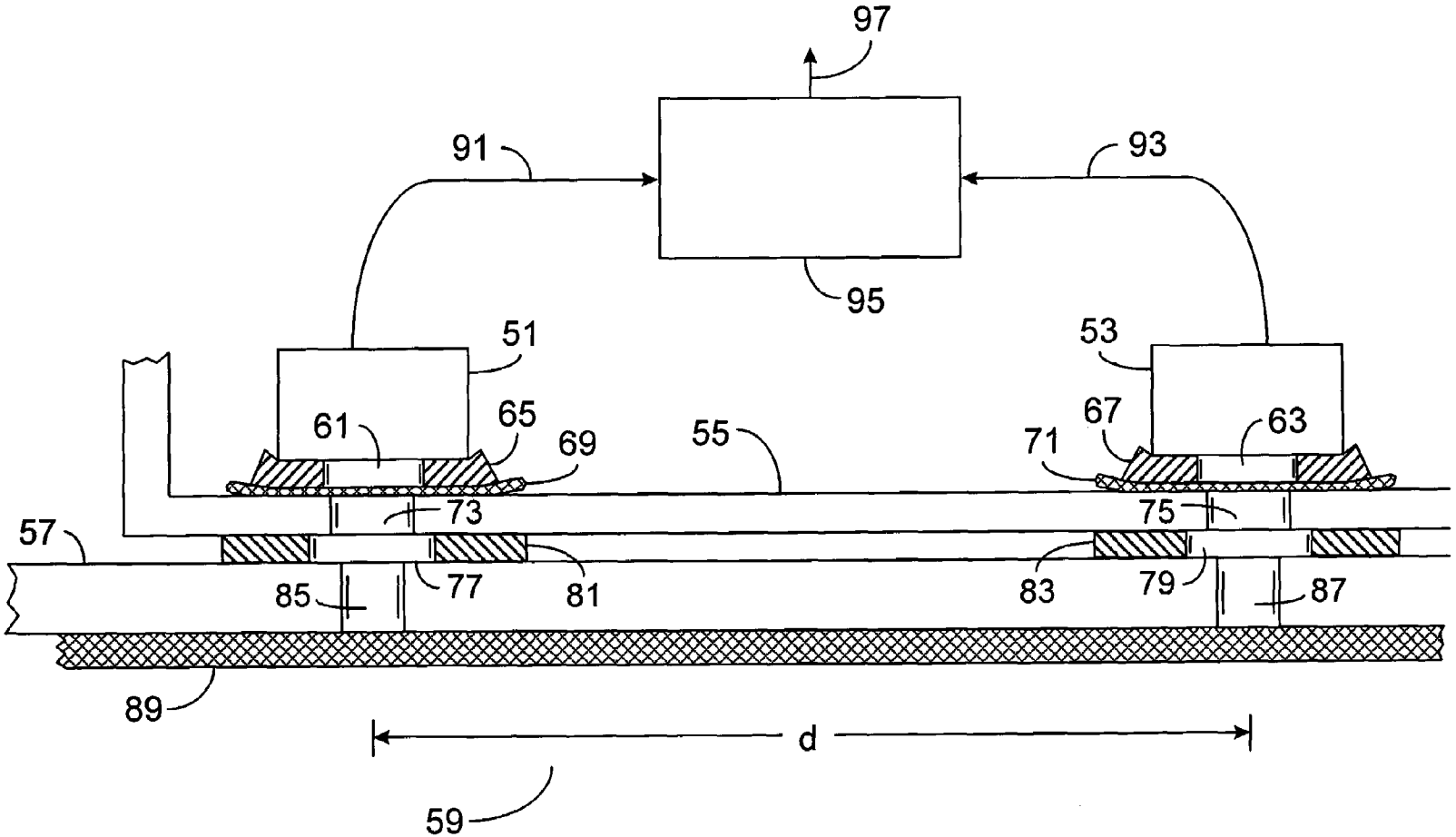
FIG. 3 is a cutaway diagrammatic view of a two-microphone element embodiment of the present invention mounted behind an acoustical barrier.

FIG. 3 shows a cutaway diagrammatic view of a two-microphone element embodiment of the present invention mounted behind an acoustical barrier such as a vehicle interior trim surface. This embodiment is representative of an assembly appropriate for mounting in the positions described in relation to FIG. 2. Omnidirectional electret condenser microphone elements 51 and 53 are positioned with their diaphragms and sound entries facing the inside surface of the microphone assembly case 55 and the rear of mounting surface/acoustical barrier 57. Sound is coupled to the diaphragms from pickup region 59 through holes 61 and 63 in case sealing gaskets 65 and 67, acoustically semi-transparent protective screens 69 and 71, holes 73 and 75 in assembly case 55, holes 77 and 79 in mounting sealing gaskets 81 and 83, holes 85 and 87 in mounting surface 57, and possibly acoustically semi-transparent decorative covering 89. With the depicted structure, sound can be coupled from the pickup region through unobtrusive openings in the mounting surface to the microphone element diaphragms while sealing out undesirable acoustic input from behind the surface. The acoustical openings through the assembly case and mounting surface may also each consist of multiple holes, slots, rings, or other patterns which exhibit reasonable acoustical openness. Other structures may be envisioned which may differ in detail from that depicted in FIG. 3, but which still achieve the stated goal of through-the-surface coupling and sealing. These are not to be construed as being outside the scope and spirit of the present invention.

Holes 85 and 87 are located in the mounting surface with an inter-hole spacing distance "d". Most generally, this will also correspond to the distance from center-to-center of the microphone element diaphragms.

Microphone elements 51 and 53 produce microphone element output signals 91 and 93, respectively, which constitute the inputs to signal processor 95. Processor 95 produces the assembly output signal 97 from these inputs.

Several aspects of the depicted structure are worth noting. First, the acoustical coupling characteristics from the pickup region to the microphone element diaphragms are likely to vary considerably from application to application, depending on the exact dimensions of the openings and the characteristics of the cloth covering, if present. Second, the acoustical paths from the pickup region to the microphone element diaphragms are still simpler and more direct than would be the case if the prior art example were similarly mounted behind such a depicted surface. Third, in direct contrast to the prior art, the acoustical couplings to each diaphragm, including the terminating impedance at each diaphragm, remain matched to each other, independent of the details of the specific mounting. This last aspect is significant because, as will be discussed in relation to FIGS. 4–9, the directional assembly output signal 97 is generated based on the instantaneous difference in pressure at each diaphragm. Acoustical signal attenuations occurring in the acoustical couplings are reflected in corresponding attenuations in the assembly output. However, identical attenuations and phase shifts in the couplings do not result in exaggerated variations in the assembly output due to the differencing operation or in polar pattern distortions.

For example, tests were conducted on an assembly with a spacing distance of 4 cm and a generated supercardioid pickup pattern. Coupling through ⅕-inch diameter, ¼-inch deep mounting surface holes resulted in barely detectable changes in response and polar pattern. Adding fairly thin, but visually opaque cloth material from a luxury car roof pillar covering still resulted in barely detectable changes. Substituting similar material with a thin foam backing or a more acoustically opaque cloth from another car resulted in about 2 decibels of on-axis sensitivity loss in the mid frequencies, but still very small change in the polar patterns. A modest deterioration of the pattern was just becoming evident in the 300 to 500 Hz range. These results are very good in comparison to what could be expected with the application of the prior art to a similar mounting, and exemplify the desirability of the invention in such subsurface applications.

Figure 4:
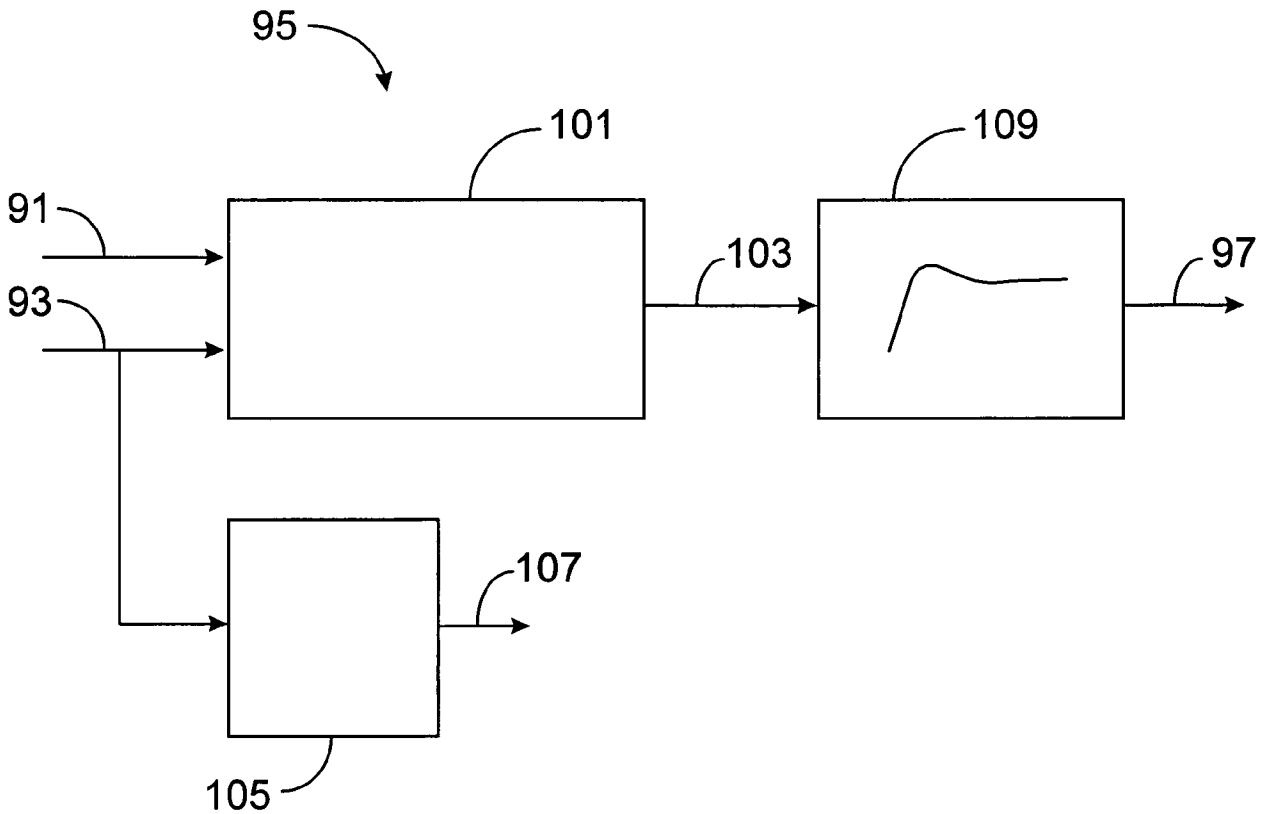
FIG. 4 is a block diagram of a microphone assembly signal processor built in accordance with the present invention.

Signal processor 95 is further detailed in block diagram form in FIG. 4. Microphone element output signals 91 and 93 enter pattern generating circuitry 101 which generates a directional pickup pattern one order higher than that of either of the matched microphone elements. In a free-space configuration, first-order directional microphones could theoretically be used, resulting in a second-order pickup pattern. In the subsurface mounting just described, omnidirectional elements are used, which will then result in a first-order pickup pattern appearing at pattern signal output 103. Next, pattern signal 103 passes into high-pass filter 109, which finally produces assembly output signal 97. The high-pass filter 109 clearly demarcates the lower end of the useful bandwidth. The benefits of this filter become evident through examination of the effects of likely mismatch errors between the two microphone elements. As mentioned above, these effects have been generally overlooked or not fully addressed in prior art descriptions of different microphone arrays.

In another embodiment, additional output circuitry 105 may be included to produce additional output 107 from either of the individual microphone element output signals. This additional output 107 may most often be used for noise-sensing functions. It will typically have an extended low-frequency response in comparison to the main directional assembly output 97, perhaps down to 100 Hz or lower. The main directional assembly output 97 does not necessarily need and, as will be discussed below in relation to FIGS. 5 and 6, should not generally be allowed to have extended low-frequency response.

Errors in the microphone assembly frequency response and polar pattern resulting from mismatches in microphone element amplitude and phase responses become greater as the frequency is lowered. Assuming omnidirectional microphone elements with basically flat frequency responses, the primary source of variations in the elements' lower frequency phase responses may be regarded as variations in their lower frequency amplitude responses. The required elements exhibit a flat frequency response down to a low frequency −3 decibel cutoff frequency which is determined primarily by a pressure-equalizing barometric leak, as is known in the art. There is also a typically smaller contribution to the low-frequency roll-off from the interaction of the element's diaphragm capacitance and the input impedance of impedance converter circuitry. Assuming that these −3 decibel cutoff frequencies are well below the anticipated useful frequency range of the array, analysis shows that the inter-element phase mismatch at frequencies within the useful frequency range can be considered to be approximately determined solely by the difference between the elements' cutoff frequencies.

Figure 5:
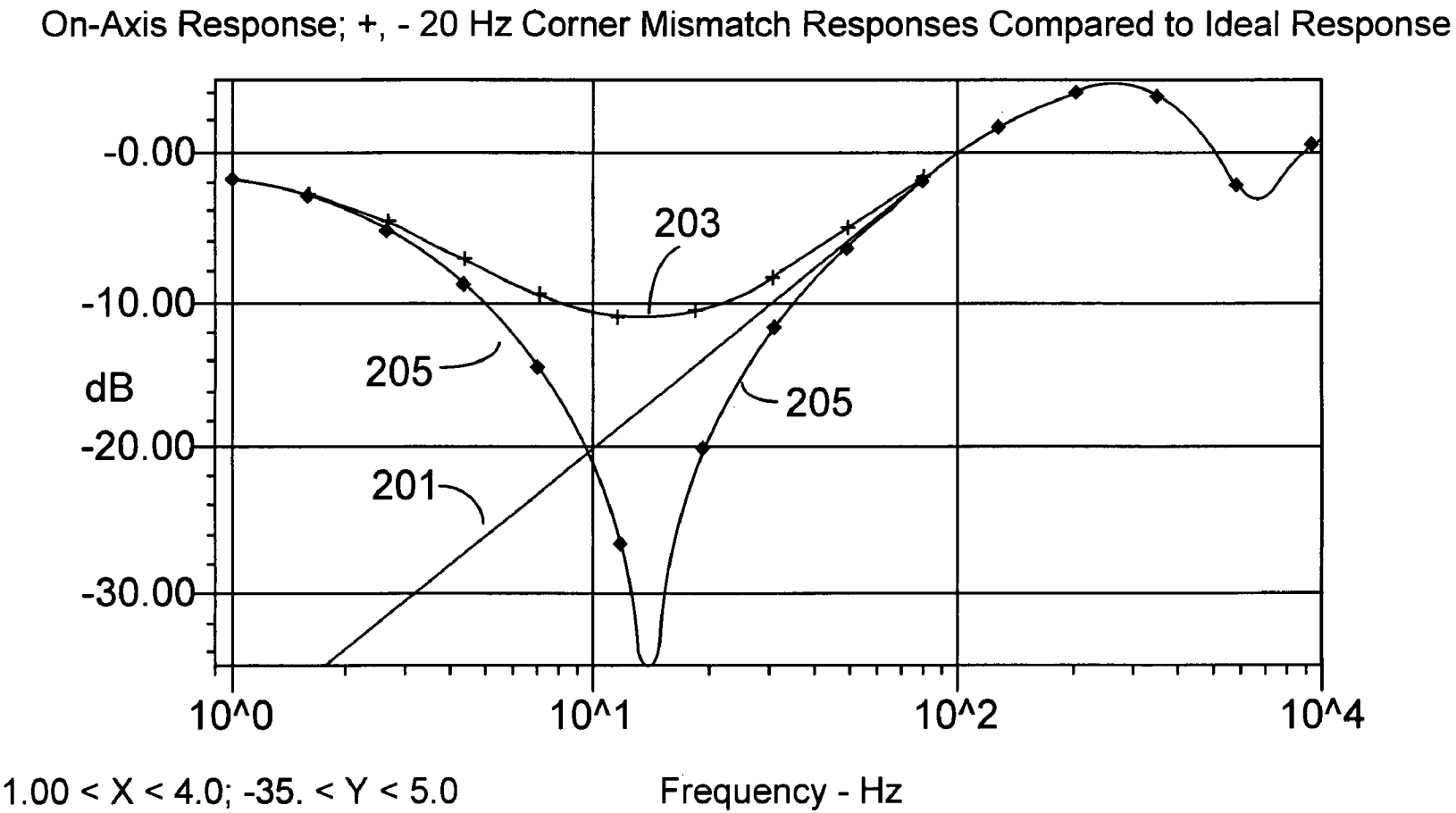
FIG. 5 is a graph showing the effects of 20 Hz low-frequency cutoff frequency mismatches on the on-axis frequency response of a two-element assembly.

FIG. 5 illustrates the effects of 20 Hz low-frequency cutoff frequency mismatches on the on-axis frequency response from 1 Hz to 10 kHz of a two-element assembly with a spacing distance between the acoustical openings of 3.5 cm and a nominal polar pattern between cardioid and supercardioid. The curve 201 is the ideal response from two perfectly matched elements. The curve 203 results from a +20 Hz cutoff frequency mismatch; that is, the front element in relation to the directional pattern has a 20 Hz cutoff and the rear element is flat to 0 Hz. The curve 205 results from the opposite mismatch. Similar results would be obtained from, for example, paired 10 and 30 Hz cutoffs or paired 25 and 45 Hz cutoffs at frequencies significantly above these cutoffs.

It is evident from the curves that even small mismatches in the elements result in greatly exaggerated low-frequency responses. These become even worse if equalization is applied towards flattening the nominal response curve. The phase mismatches can also totally alter the directional pattern. The pattern at the curve 205 null at about 140 Hz, for example, becomes a rear-facing cardioid. The excess uncontrolled low-frequency response can be very problematic in light of the high levels of low-frequency acoustic energy present in many applications, especially when gain is applied to bring the assembly output up to useful levels.

Figure 6:
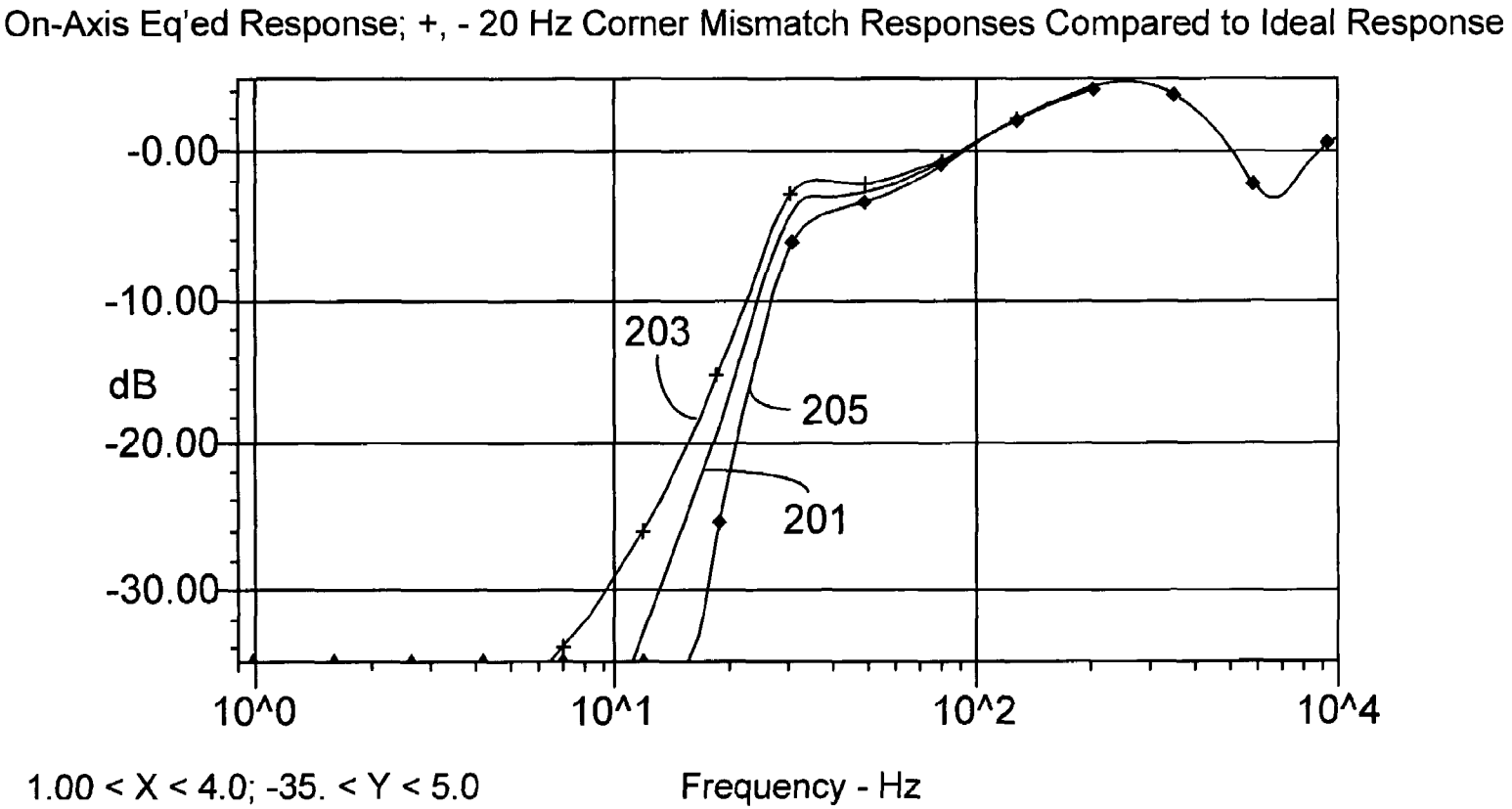
FIG. 6 is a graph showing the added effect of an under-damped 300 Hz high-pass filter of the present invention on the response of FIG. 5.

Three primary remedies for the matching problem can be applied in the present invention. First, as will be discussed in relation to FIG. 9, gain adjustment means are provided to allow close matching of the effective midband amplitude sensitivity of the microphone element signals before the differencing operation. Second, microphone elements are employed which inherently have close matching of their low-frequency cutoff frequencies. This can be achieved by employing elements with fairly low and well controlled cutoffs in, for example, the range of 20 Hz to 40 Hz, or with very low, but more poorly controlled cutoffs in, for example, the range of 5 Hz to 25 Hz, or, simply, lower than 20 Hz. These represent cutoff mismatches of no greater than 1/15 of the 300 Hz lower frequency limit of the useful assembly frequency range. Usable assemblies could still be made with cutoff mismatches as high as 1/5 of the useful frequency range lower limit, but the tighter tolerances are much more desirable. Third, a high-pass filter is included following the pattern-generating differencing operation which clearly demarcates the lower end of the useful frequency range. FIG. 6 shows the effect of adding a second-order 300 Hz high-pass filter to the three curves of the previous figure. The curves demonstrate the benefit of essentially eliminating the troublesome uncontrolled low-frequency response before it is further amplified and input to following systems.

The particular second-order high-pass filter applied in FIG. 6 is underdamped, with a damping factor of 0.27. This gives a boost at the 300 Hz corner frequency of 5.3 dB. This helps to shape the desired frequency response within the useful frequency range to more closely match an ideal narrowband speech communication response. The graph also shows a falloff in response above 3 kHz. This is determined by the spacing distance between the acoustical openings and by the nominal generated directional pattern, as will be discussed further in relation to FIG. 8.

Figure 7:
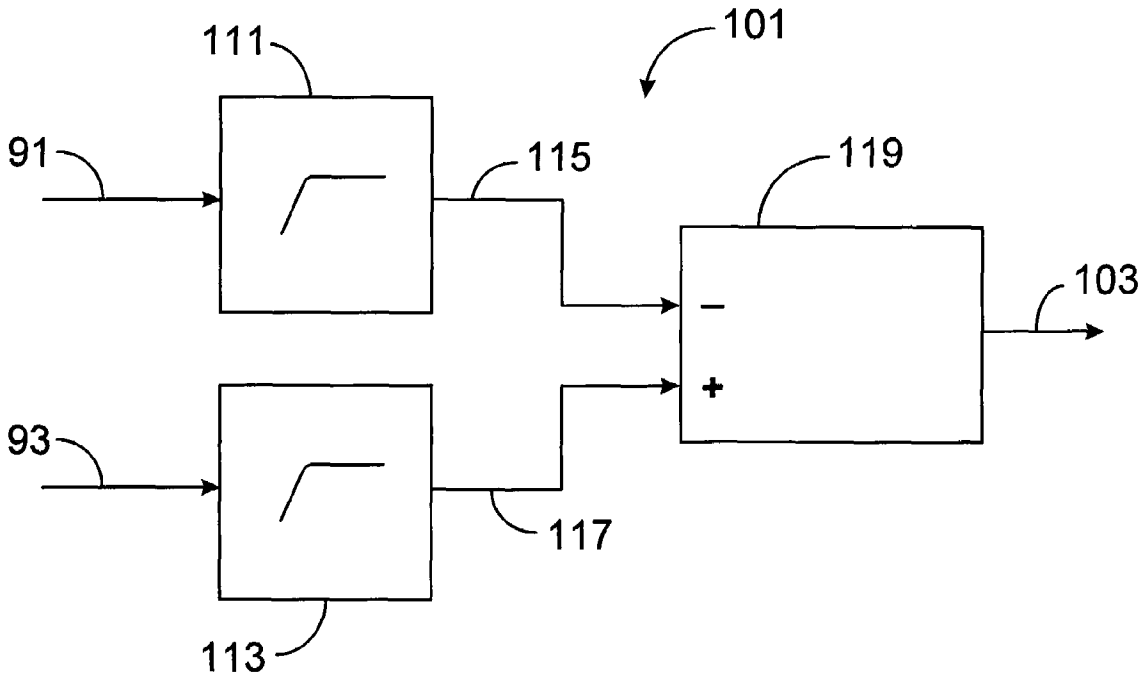
FIG. 7 shows detail of one embodiment of a pattern generating circuit block built in accordance with the present invention.

FIG. 7 shows detail of one embodiment of the pattern generating circuitry 101 from FIG. 4. Microphone element output signals 91 and 93 enter high-pass roll-off filters 111 and 113, respectively, which produce rolled-off signals 115 and 117, respectively. Signals 115 and 117 enter differencing circuit 119, which then produces pattern signal 103. In this case, the directional pattern generated from omnidirectional microphone element signal inputs is bidirectional. The roll-off filters' function is to greatly attenuate very low-frequency signals from the extended frequency-response microphone elements before they are further processed or any significant gain is applied. This greatly reduces the microphone assembly's sensitivity to large, very low frequency transients. To provide significant benefit, these filters will have corner frequencies above the low-frequency cutoff frequencies of the microphone elements.

In an analog circuit implementation, the roll-off filters will generally be first-order, reasonably closely matched, and have corner frequencies somewhat below the lower limit of the useful frequency range. All these things contribute to minimizing the introduction of any phase mismatches to the front and rear element signals. Just a few degrees of mismatch can seriously upset the response and polar pattern at the lower limit of the useful frequency range. For a 300 Hz lower limit, a roll-off corner frequency of 50 Hz to 100 Hz would be typical. Even greater very low-frequency attenuation could be achieved at these circuit points with second or higher order filters such as that typically employed in high-pass filter 109 in FIG. 4, but an analog implementation of two steep roll-off filters would have great difficulty maintaining the desired tight phase-matching. Well-matched, gradual roll-off filters with corners between the microphone element low-frequency cutoffs and the lower limit of the microphone assembly's useful frequency range immediately applied to the element signals and a steeper high-pass filter following the differencing operation are appropriate design choices for an analog implementation. Alternatively, all or a portion of the microphone assembly signal processing could be implemented digitally. Analogto-digital conversion could take place with microphone element output signals 91 and 93, rolled-off signals 115 and 117, or pattern signal 103. Roll-off filters 111 and 113 would be perfectly matched if implemented digitally, allowing more freedom in their design. However, placing the filters before the A-to-D conversion would protect the converter from excessive very low-frequency signals.

Figure 8:
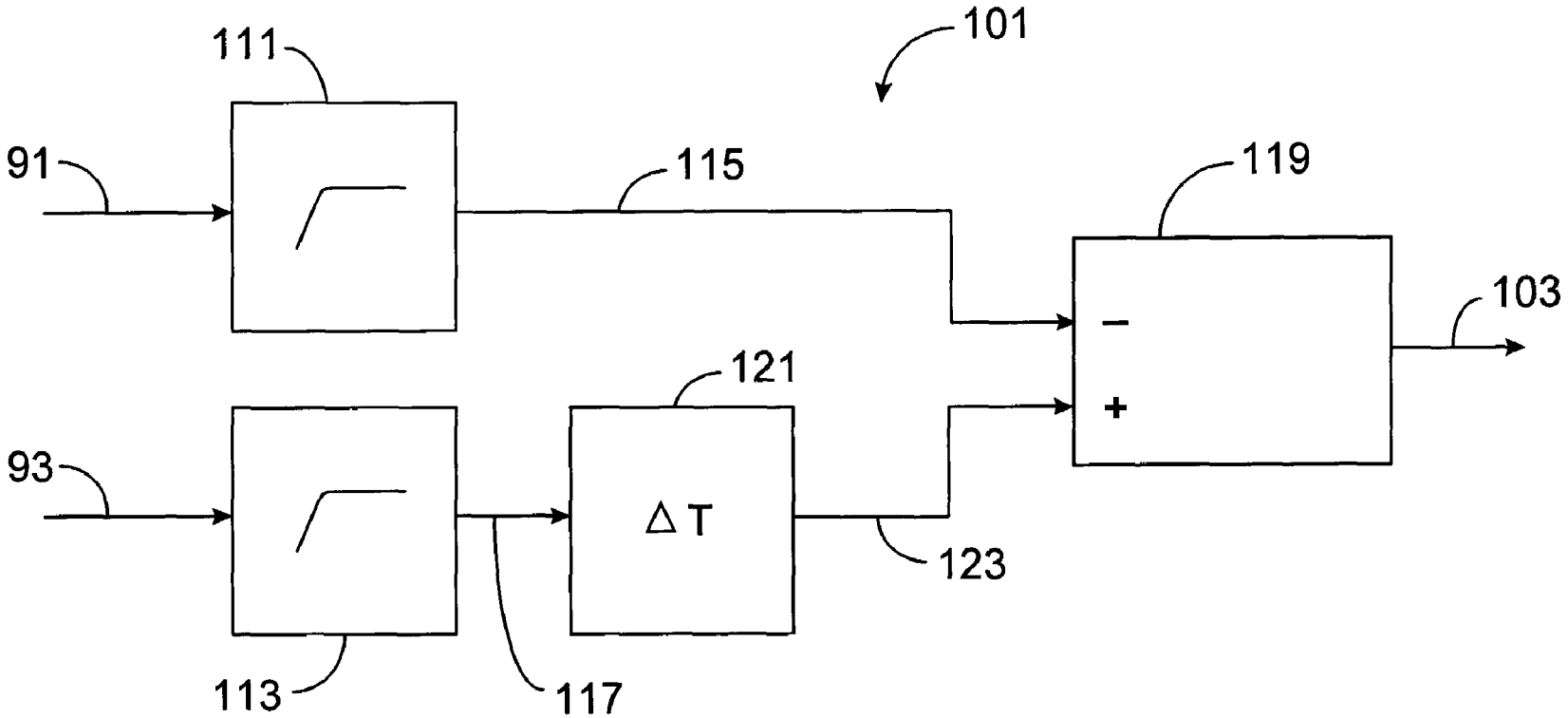
FIG. 8 shows detail of another embodiment of the pattern-generating circuit block built in accordance with the present invention.

FIG. 8 shows detail of another embodiment of the pattern generating circuitry 101 from FIG. 4. This circuitry differs from the pattern generating circuitry of FIG. 7 only in the addition of delay 121, which delays rolled-off signal 117 to produce delayed signal 123. Delayed signal 123 is then input into differencing circuit 119, along with rolled-off signal 115. The inclusion of delay 121 allows first-order patterns other than bidirectional to be generated. For a first-order pattern defined by 1−B+B*cos(theta), the required delay is given by (d/c)*(1−B)/B, where d is the acoustical opening or inter-element spacing distance and c is the speed of sound. For a pattern between cardioid and supercardioid, B=0.586, and with d=3.5 cm, the delay 121 should be approximately 72 usec. This delay may be implemented digitally, or approximated in analog circuitry over the useful directional frequency range with an all-pass filter or a low-pass filter. The on-axis response curves of FIGS. 5 and 6 were generated with a critically-damped, second-order low-pass filter having a corner frequency of 4.45 kHz. The low-pass filter exhibits an advantage over the all-pass filter or the pure delay in that deep high-frequency response nulls are avoided. Instead, the directional pattern blends smoothly to omnidirectional above the low-pass corner frequency. The net result is a microphone assembly which exhibits excellent pattern control and directivity relative to typical use angles of 30 to 60 degrees off-axis (a talker will not be exactly on-axis to a surface-mounted microphone) over a useful frequency range of 300 Hz to 3 kHz, usable response and directivity up to 5 kHz, and usable frequency response up to the upper limit of the microphone elements and their acoustical coupling.

Employing a narrower element spacing distance would allow the maintenance of good directivity to higher frequencies, but this is not necessary in anticipated applications and would compromise other benefits. Maintaining the widest spacing possible within the constraint of maintaining good directivity up to an upper frequency limit minimizes the assembly's sensitivity to any mismatches in the acoustical coupling differences or the microphone elements. The largest possible element spacing distance creates the largest possible inter-element pressure differences from the desired sound pickup, and thus minimizes the relative sensitivity to mismatch errors. The polar pattern-determining factor B and the wavelength W of an upper frequency limit for good directivity set the spacing distance approximately according to the formula d=K*W*B. K may optimally be about ½, but could vary over the range of ⅓ to ⅘ while still maintaining reasonable results. A K of less than ⅕ may exhibit excessive sensitivity to mismatches to allow a useful working frequency range.

Figure 9:
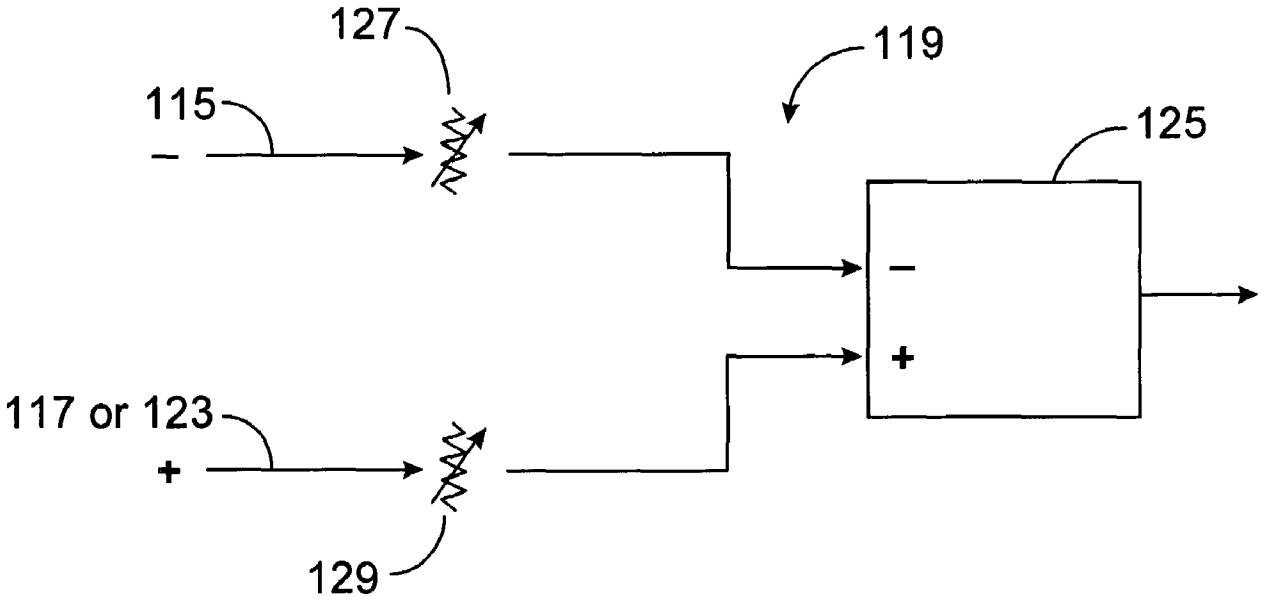
FIG. 9 shows detail of the differencing circuit built in accordance with the present invention.

FIG. 9 shows detail of the differencing circuit 119 from FIG. 7 or 8. One input to differencing stage 125 comes from rolled-off signal 115 while the other comes from either rolled-off signal 117 or delayed signal 123. Interposed in these input paths are gain adjusters 127 and 129. Either or both of these may be employed to trim out midband amplitude sensitivity differences in the two associated microphone elements to ensure precise matching of the effective electroacoustic sensitivities applied to the differencing stage.

As mentioned in relation to FIG. 2, two or more microphone assemblies may be employed to facilitate more complete coverage of a vehicle cabin or other pickup space. Automatic combining becomes desirable as microphone assemblies are added to avoid degradation in the signal-to-noise ratio of the combined output. FIG. 10 illustrates four microphone assemblies 131, 133, 135, and 137 sending their output signals to automatic selector/combiner circuitry 139, which outputs combined signal 141. The selector combiner/circuitry may advantageously be of the type described in the previously referenced Julstrom patent.

Figure 11:
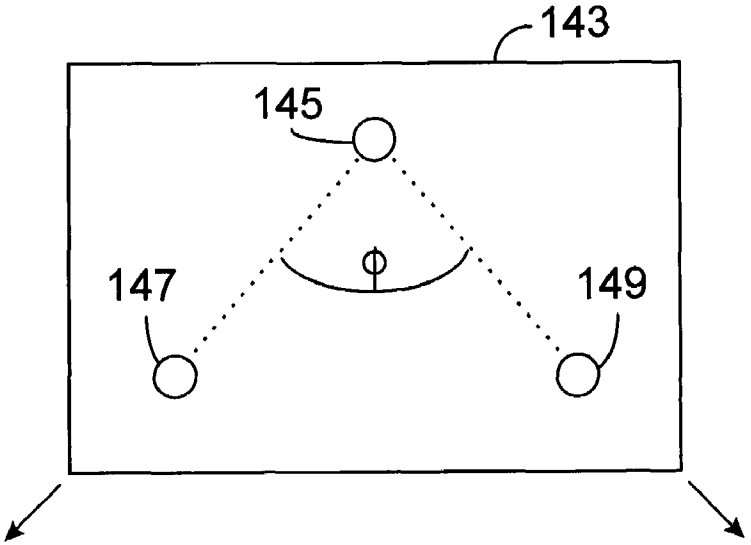
FIG. 11 shows one embodiment of a combination assembly of the present invention arranged to provide full left-right coverage.

Referring again to FIG. 2, microphone assemblies 37 and 39, if used together, provide excellent coverage of the front seat, for driver and central and side passenger positions. They may be positioned very close to each other, near the vehicle centerline, and each angled outwards about 45 degrees. FIG. 11 shows a combination assembly 143 arranged to perform a similar function, but with a rear microphone element 145 which is common to both left-angling pattern generation circuitry which also employs microphone element 147 and right-angling pattern generating circuitry which also employs microphone element 149. The left and right-angling patterns are angled outwards from each other by an included angle phi. If the left-angling pattern is described by 1−B+B*cos(theta), then the right-angling pattern can be described by 1−C+C*cos(theta+phi). Most typically, the two patterns will be the same and B and C will be equal.

Figure 12:
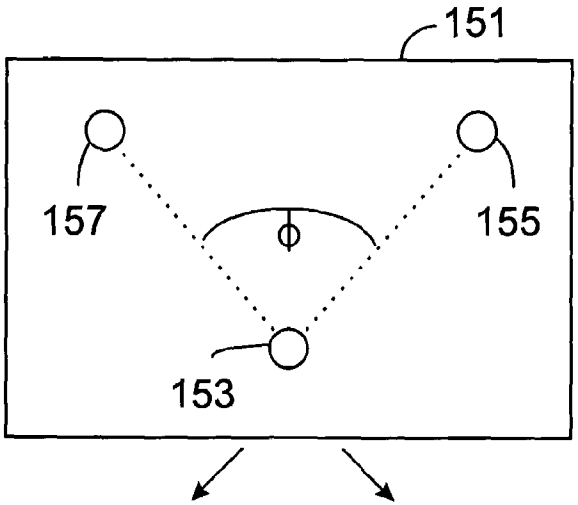
FIG. 12 shows an alternate embodiment of the combination assembly of the present invention.

FIG. 12 shows an alternate embodiment of combination assembly 151. Here, the common microphone element is front element 153, which forms a left-angling pattern with element 155 and a right-angling pattern with element 157. In either combination assembly, additional patterns could be developed from the available elements, but the left and right-angling ones described are generally useful in anticipated applications. The outputs of the two pattern generating circuits may optimally be combined with an automatic selector/combiner, which would generate one or more intermediate patterns that are combinations of the basic left and right-angling ones.

Figure 13:
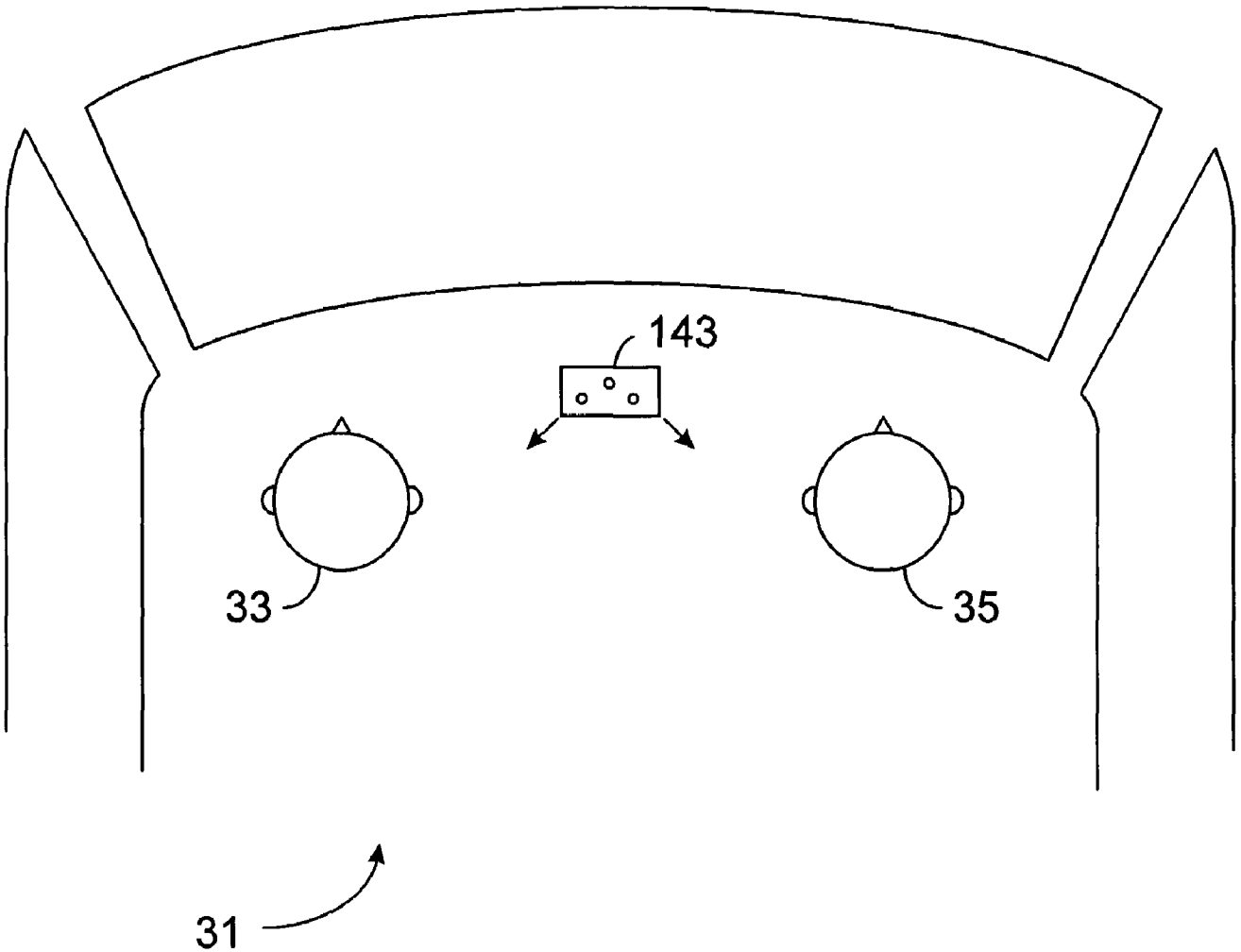
FIG. 13 shows an application of a combination assembly in a vehicle cabin in accordance with the present invention.

FIG. 13 shows an application of combination assembly 143 in vehicle cabin 31. Both driver 33 and passenger 35 are well-covered, and rejection of interfering dashboard-originating noises is maintained in all conditions of the automatic selector/combiner.

Figure 14:
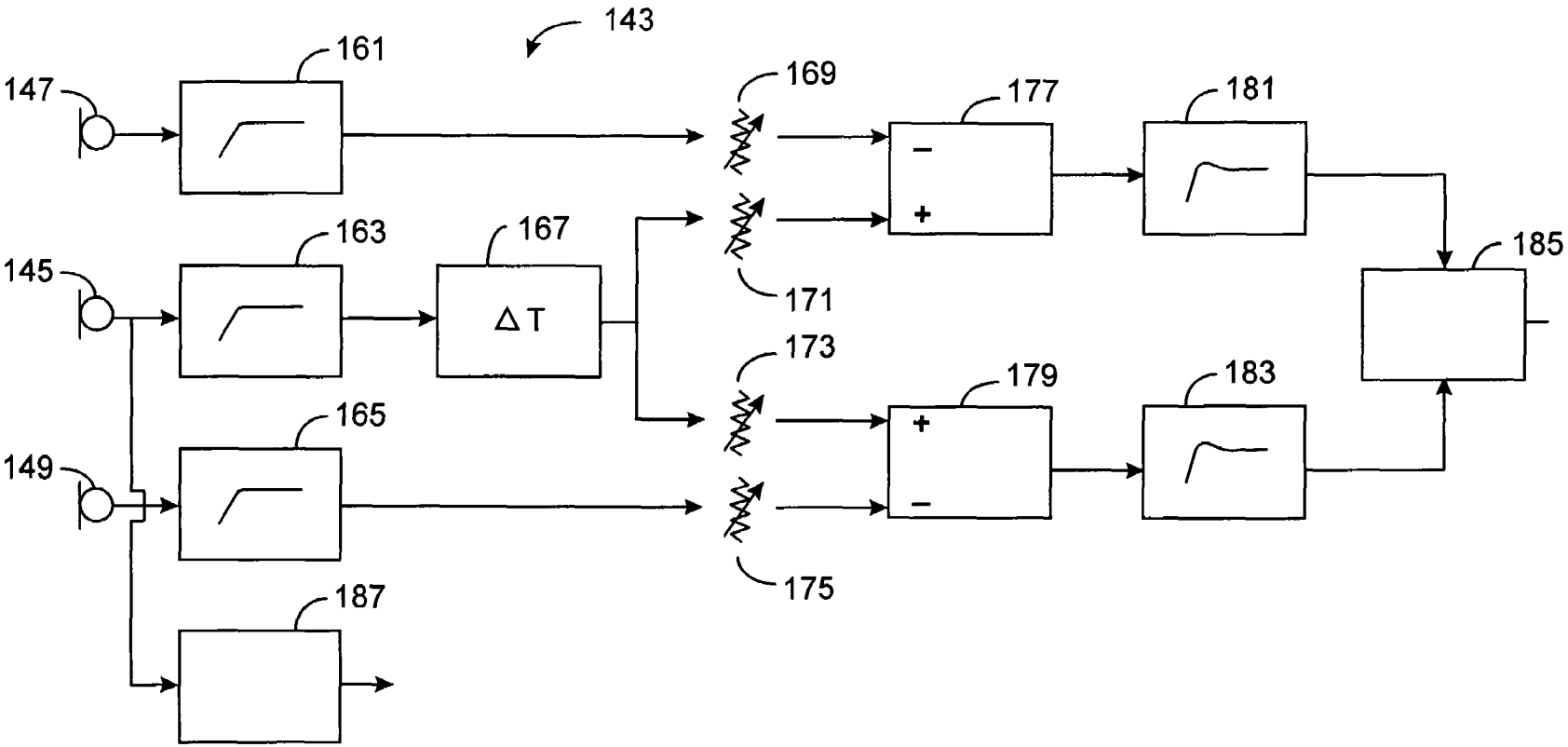
FIG. 14 shows a detailed block diagram of a combination assembly of the present invention.

FIG. 14 shows a detailed block diagram of combination assembly 143. The electrical signal sources are microphone elements 145, 147, and 149. Included are three roll-off filters 161, 163, and 165 which serve the same function as those described in relation to FIG. 7, a delay 167 which serves the same function as that described in relation to FIG. 8, up to four gain adjusters 169, 171, 173, and 175, two differencing stages 177 and 179 which serve the same functions as those described in relation to FIG. 9, high-pass filters 181 and 183 which serve the same function as those described in relation to FIG. 4, an automatic selector/combiner 185, and additional output circuitry 187 which serves the same function as that described in relation to FIG. 4.

Referring again to FIG. 4, main assembly output signal 97 will generally feed the vehicle telephony equipment. Additional output 107 may be used to feed the entertainment audio system for automatic level and spectrum adjustment based on cabin noise. While not desirable, it is possible that the vehicle electrical layout may dictate that the telephony and entertainment systems be tied to significantly differing ground points, with some degree of differential noise between them. If the two grounds are then tied together by common circuitry in the microphone assembly, noise could be introduced into both assembly outputs. A possible solution to this potential problem is to provide a partially ground-isolated output for one of the assembly outputs, for example, additional output 107.

Figure 15:
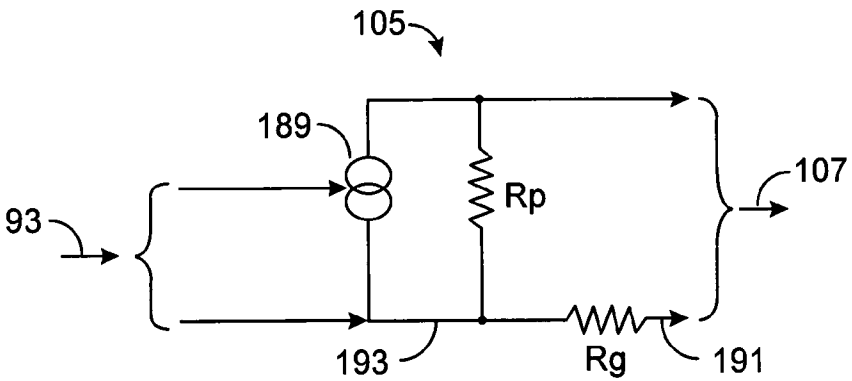
FIG. 15 shows detail of one embodiment of additional output circuitry built in accordance with the present invention.

FIG. 15 shows detail of one embodiment of additional output circuitry 105 which achieves this solution. Microphone element output signal 93 excites high-impedance output stage 189, having output impedance Ro. A local ground 191 is developed which is partially isolated by ground resistance Rg from the main microphone assembly ground 193. Ground resistance Rg should be large enough to prevent significant inter-ground current flow resulting from any expected inter-ground voltage differentials. A value of at least 1/50 of expected additional output load resistance should generally be adequate. For a load resistance of 1 kOhm, Rg would be at least 20 Ohms. Output resistance Ro should generally be large enough to significantly attenuate any inter-ground voltage differential-induced noise appearing on the load resistance. A reasonable minimum value of 5 times the expected load resistance would provide 15 decibels of such attenuation. A factor of 100 times or more would generally be preferable. For a load resistance of 1 kOhm, Ro should generally be at least 5 kOhms with 100 kOhms or more ordinarily being preferable.

It should be understood, of course, that the foregoing description refers only to a subset of the possible embodiments of the invention and that modifications or alterations may be made therein without departing from the spirit or scope of the invention as set forth in the appended claims.

What is claimed and desired to be secured by Letters Patent is:

1. A microphone assembly comprising:

at least two microphones, each of said at least two microphones receiving sound energy and generating electrical signals corresponding to the sound energy received;

signal processing circuitry, said signal processing circuitry processing the electrical signals into an assembly output signal;

said at least two microphones and said signal processing circuitry being configured to limit adverse effects on the assembly output signal from amplitude and phase mismatches between the at least two microphones; and a case for housing said at least two microphones and said signal processing circuitry, wherein said case is mounted on a mounting side of an acoustical barrier, the acoustical barrier comprising an interior surface of a passenger vehicle.

2. A microphone assembly comprising:

at least two microphones, each of said at least two microphones receiving sound energy and generating electrical signals corresponding to the sound energy received;

signal processing circuitry, said signal processing circuitry processing the electrical signals into an assembly output signal;

said at least two microphones and said signal processing circuitry being configured to limit adverse effects on the assembly output signal from amplitude and phase mismatches between the at least two microphones;

a case for housing said at least two microphones and said signal processing circuitry, wherein said case is mounted on a mounting side of an acoustical barrier; and at least one sealing gasket located between said case and the mounting side of the acoustical barrier.

3. The microphone assembly according to claim 2 wherein the acoustical barrier comprises an interior surface of a passenger vehicle.

4. A microphone assembly comprising:

at least two microphones, each of said at least two microphones receiving sound energy and generating electrical signals corresponding to the sound energy received;

signal processing circuitry, said signal processing circuitry processing the electrical signals into an assembly output signal;

said at least two microphones and said signal processing circuitry being configured to limit adverse effects on the assembly output signal from amplitude and phase mismatches between the at least two microphones;

a case for housing said at least two microphones and said signal processing circuitry; and at least two protective screens located between an inner surface of the case and the at least two microphones.

5. The microphone assembly according to claim 4 wherein the case is mounted on a mounting side of an acoustical barrier.

6. The microphone assembly according to claim 5 wherein the acoustical barrier comprises an interior surface of a passenger vehicle.

7. A microphone assembly comprising:

at least two microphones, each of said at least two microphones receiving sound energy and generating electrical signals corresponding to the sound energy received;

signal processing circuitry, said signal processing circuitry processing the electrical signals into an assembly output signal;

said at least two microphones and said signal processing circuitry being configured to limit adverse effects on the assembly output signal from amplitude and phase mismatches between the at least two microphones;

a case for housing said at least two microphones and said signal processing circuitry, wherein said case is mounted on a mounting side of an acoustical barrier; and a covering located on at least a portion of a pick-up side of the acoustical barrier.

8. The microphone assembly according to claim 7 wherein the acoustical barrier comprises an interior surface of a passenger vehicle.

9. A microphone assembly comprising:

at least two microphones, each of said at least two microphones receiving sound energy and generating electrical signals corresponding to the sound energy received;

signal processing circuitry, said signal processing circuitry processing the electrical signals into an assembly output signal and generating an additional output signal having an extended low frequency response in comparison to the assembly output signal;

said at least two microphones and said signal processing circuitry being configured to limit adverse effects on the assembly output signal from amplitude and phase mismatches between the at least two microphones;

a case for housing said at least two microphones and said signal processing circuitry, wherein said case is mounted on a mounting side of an acoustical barrier, the acoustical barrier comprises an interior surface of a passenger vehicle; and at least one sealing gasket located between said case and the mounting side of the acoustical barrier.

* * * * *